United States Patent [19]

Bollmann

[11] Patent Number: 4,662,139

[45] Date of Patent: May 5, 1987

[54] BASE SUPPORT FOR POLE

[76] Inventor: Jean-Jacques Bollmann, Flühgasse 49, 8008 Zürich, Switzerland

[21] Appl. No.: 901,907

[22] Filed: Aug. 27, 1986

[30] Foreign Application Priority Data

Aug. 30, 1985 [DE] Fed. Rep. of Germany ..... 3531087

[51] Int. Cl.[4] ..... E02D 27/42

[52] U.S. Cl. ..... 52/296; 52/169.13; 403/86

[58] Field of Search ..... 52/292, 296, 295, 169.13, 52/298; 403/86; 256/21

[56] References Cited

U.S. PATENT DOCUMENTS

| | | | |
|---|---|---|---|
| 4,279,107 | 7/1981 | Bollmann | 52/169.13 |
| 4,406,094 | 9/1983 | Hempel et al. | 52/296 X |
| 4,603,526 | 8/1986 | Bollmann | 52/296 |

FOREIGN PATENT DOCUMENTS

| | | | |
|---|---|---|---|
| 2443544 | 8/1980 | France | 52/296 |

*Primary Examiner*—J. Karl Bell

*Attorney, Agent, or Firm*—Townsend and Townsend

[57] ABSTRACT

A base support for fastening a pole (45) standing off from a foundation (31) is provided with a base member or an anchor body (11) respectively to be anchored in the foundation, presenting an all-around running side wall (14) and at its top a thru hole (26) surrounded by a circular bearing face (18) proceeding transversally to the base wall. Furthermore, a pole supporting member (16) is provided presenting on its top a connection area for the pole (45), below an all around running side wall (20) and at its bottom a mounting wall (23) presenting a circular supporting surface (19) being complementary to the bearing surface (18). For a simultaneous performance of the fastening bolt functioning, an anchor bolt (12) is passed through a central boring (15) of the mounting wall (23) across a tapered ring (22) and is screwed down in the foundation.

9 Claims, 4 Drawing Figures

BASE SUPPORT FOR POLE

Figure 1:
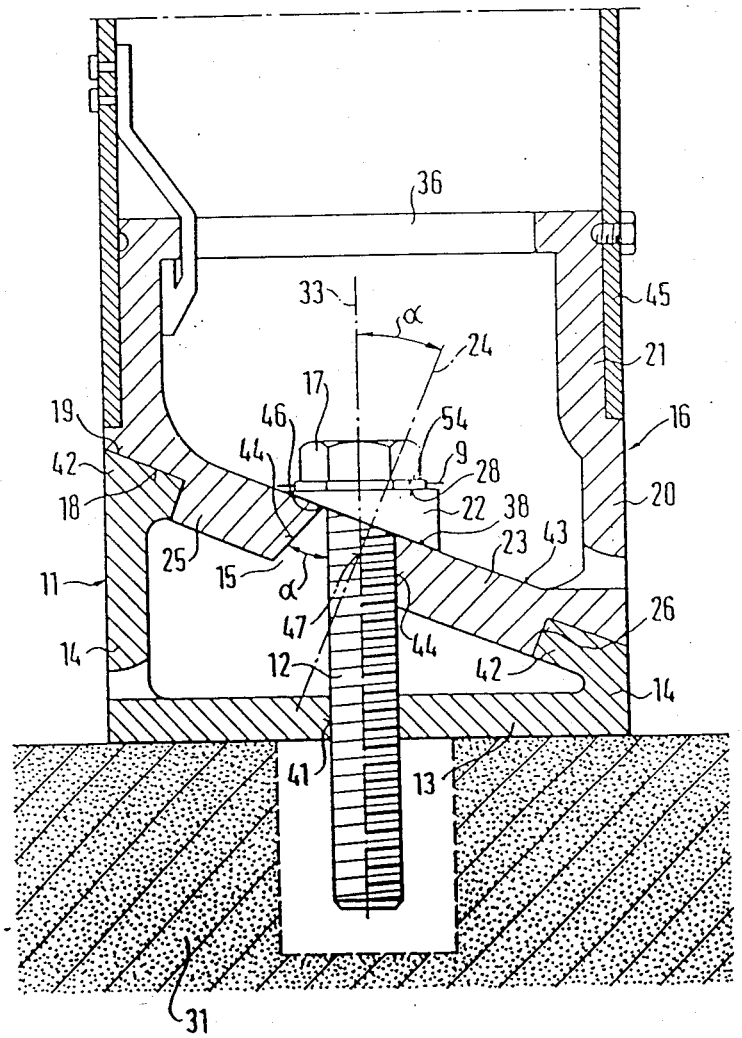

This invention relates to a base support for fastening a pole standing off from a foundation, provided with a base member or an anchor body to be anchored in the foundation which shows below a base wall being attachable in relation to the foundation by a central anchor bolt or connection bolt and rotatable around a first rotation axis which is substantially perpendicular to the foundation, above it an all around running side wall, and on the top a thru hole surrounded by an circular, ring-shaped covering wall which proceeds transversely to the base wall and has such a dimension that through the thru hole the anchor bolt is insertable, and provided with a pole supporting member showing above a connecting area for the pole, below an all around running side wall, and at the bottom a mounting wall having a circular supporting surface which is complementary to the bearing surface, whereby the mounting wall is provided with a central boring for permitting a rotation around a second rotation axis proceeding perpendicular to the bearing or supporting surface, whereby the central boring serves for passing through a fastening bolt which has a perpendicular position to the bearing or supporting surface and secures the mounting wall to the base member, thus establishing a firm axial clamp joint between the bearing and the supporting surface, the fastening bolt being axially braced against the mounting wall and accessible by an access opening in the upper area of the pole member, whereby preferably radially outside the central boring between the annular covering wall and the mounting wall an axial, dynamically balanced insert connection is provided, being concentric to the second rotation axis, by means of which the base member and the pole member are rotatable around the second rotation axis, but radially immovably connected. A pole, within the meaning of the invention, is any oblong structural member which shall be secured with one end to the floor. Profiles of any type which particularly also include hollow sections, may be concerned herewith. The definition of the term base support for pole means, in the most far-reaching understanding, that it not only applies to horizontal and inclined floors but also to perpendicular or even salient walls.

According to a prior art base support for pole of the type (CH-PS 622 845), the pole supporting member has to be attached to the base member by the relatively complicated construction of a bajonet catch-type connecting arrangement, the loading capacity of which is not very high, so that only relatively lightweight, oblong structural members can be disposed at the pole supporting member which are not subjected to great lateral stress. On the other hand, however, the bajonet catch-type connecting arrangement can not be omitted since the pole supporting member has to be open on top for operating the central anchor bolt as well as for its insertion or removal.

In order to avoid the shortcomings of the above described mechanism, it has previously been proposed (EP-OS 84 112 151.0-2303/152 530) to provide radially outside the access opening between the base wall and the mounting wall an axial, dynamically balanced insert connection which is concentric to the second rotation axis, and to secure the central stub bolt in the peripheral area of the access opening, still radially within the insert connection, however, to the base member by a screw joint being accessible and operatable from above, with the pole supporting member being removed. Due to this design, the space within the dynamically balanced and a relatively large cross-section showing insert connection is utilized for obtaining there, by means of the stud bolt being accessible from above, an additional solid connection between the base member and the pole supporting member.

Even if the above described base support for pole assures an extremely solid and strong anchoring of the poles in a foundation, employment of two mounting elements which have to be operated successively turns out to prove a certain disadvantage which has its effects on such applications which do not require a strong and solid arrangement of pole-shaped members in a foundation.

The object of the invention is to provide a base support for fastening a pole of the type described in the outset whereby the base member can be fixed at the ground or at an anchor body and the pole supporting member at the base member while using one and the same screw without impeding the relative twisting ability of the components which represents the very purpose of those pole fastening devices.

To solve this problem, the invention provides, for a simultaneous performance of the fastening bolt funtioning, to pass the anchor bolt through the central boring of the mounting wall and to keep it with its head area in frictional connection with a power transmitting device transmitting at least partially the component proceeding perpendicular to the bearing and supporting surface of the tension force operating in axial direction of the anchor bolt, the power transmitting device being, in all relative rotary positions of the base member and of the pole supporting member, in a jam-free frictional connection proceeding perpendicular to the mounting wall and in axial direction of the anchor bolt, respectively, as well with the pole supporting member as with the anchor bolt.

Therefore, the object of the invention is to be seen in the fact that one and the same crew is used as well for anchoring the base member in the ground as for a relative attachment of the pole supporting member and the base member. One has to pay attention, however, that jamming has to be avoided between the anchor bolt and the individual construction elements in the case of a relative twisting of the components.

In order to assure the above described functioning with a first but particularly simple embodiment, the invention provides to design the power transmitting device as a tapered ring which shows a wedge angle equalling the angle between the two rotation axes through which the anchor bolt extends, and at the upper surface of which, proceeding perpendicular to the anchor bolt axis, the head of the anchor bolt sits close, whereby the lower wedge surface sits close on all sides, preferably, at the oblique mounting wall.

In the most simple case, the tapered ring provided with two plane faces can simply be turned by hand into the twisting position which assures fitting, before tightening the anchor bolt.

A particularly preferred embodiment of the invention is characterized in that the power transmitting device is developed as a spherical supporting member provided in the head area of the anchor bolt, the center of which coincides with the intersecting point of the two rotation axes, and the hereto complementary spherical surface sections intended at the mounting wall of the pole supporting member, whereby the spherical supporting member and the spherical surface sections extend and are disposed in such a way that, on the one hand, they are capable of transmitting the tension forces and, on the other hand, to permit a free relative rotation of the base member and the pole supporting member, with the anchor bolt being relaxed, and that the spherical supporting member preferably extends upwards and downwards at least as far as the spherical surface sections will reach. Use of a ball and spherical surface sections avoid jamming of every kind when twisting the components relatively to each other, while at the same time the requisite tension forces can be perfectly transmitted.

A further preferred constructional embodiment is developed in a way that the spherical surface sections located at the borders of the central boring of the mounting wall are forming a bowl being open towards the top and a ring being concentric and symmetric to the second rotation axis.

A specific development of the anchor bolt is unnecessary in case the spherical supporting member in the head area of the anchor bolt is arranged as a special construction element. In that case, the spherical supporting member equipped with an adequate boring and recesses can simply be slipped from beneath onto a usual commercial stud bolt.

A further simplified embodiment is characterized in that the power transmitting device is formed by a traction part at the upper end of the anchor bolt being angled by $\alpha$ between the two rotation axes, and that the traction part extends through the central boring and is braced against the upper surface of the mounting wall.

In that case, the traction part can be provided with a male thread in the area of the central boring and above it, and is braced against the surface by a screw nut paralleling the upper surface of the mounting wall. Hereby, the traction part can be formed by an angled upper part of the anchor bolt itself.

For realizing a trouble-free rotation around an axis standing perpendicular on the base wall, a further embodiment provides an axial insert connection being dynamically balanced and concentric to the first rotation axis, between the base wall of the base member and an anchor body being mounted in the foundation, too.

It turns out to be an advantage when the base member and the pole supporting member present a substantially circular cylindrical cross-section.

It will be appropriate for any practical embodiment if the base member and the pole supporting member substantially present the same exterior diameter when aligning their cylinder axes.

An especially functional dimensioning is characterized in that the circular bearing surface comprises an angle of 20° to 25°, in particular of 22.5° with the base wall and that, as the case may be, the spherical surface sections extend so far upwards and downwards that the cylinder axis of the pole supporting member can be continuously adjusted between a position aligned with the rotation axis to an angle below 40° to 50°, and in particular to 45°.

Figure 2:
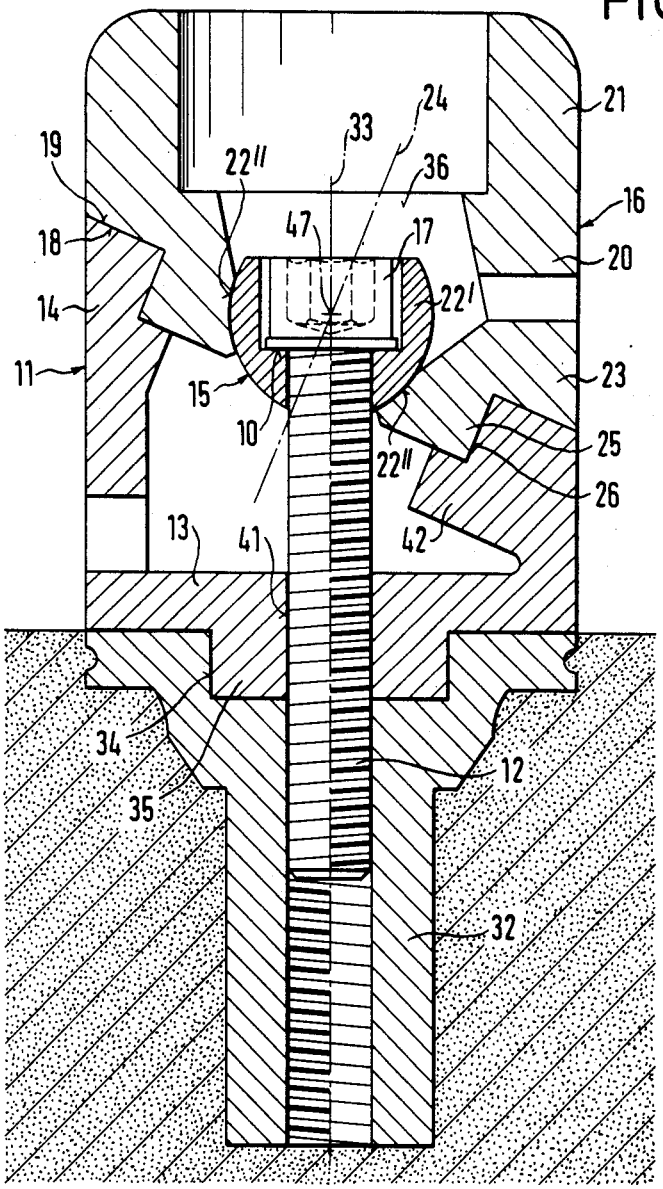
Figure 3:
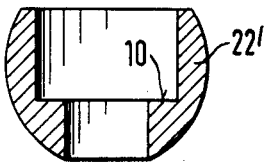
Figure 4:
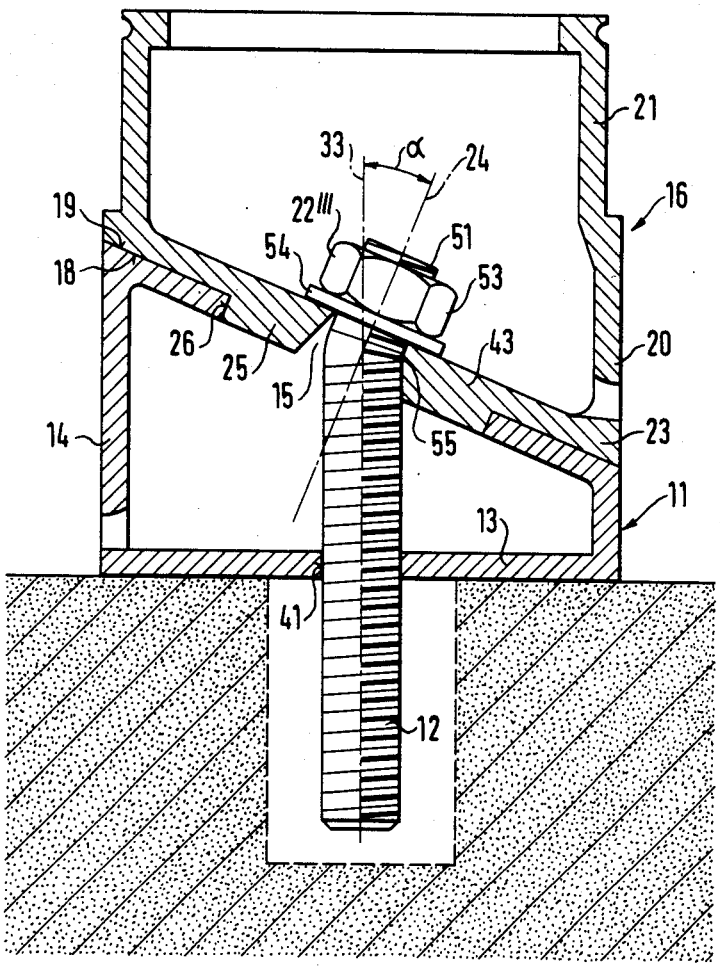

The invention will be apparent from the following description, made by way of example with reference to the accompanying drawings, wherein:

FIG. 1 is a vertical section through a first, particularly simple embodiment of the base support for pole according to the invention, FIG. 2 is a vertical section through a further embodiment of the invention showing a special development of the spherical supporting member, FIG. 3 is a section through the spherical supporting member used with the embodiment according to FIG. 2, and FIG. 4 is a simplified embodiment in which the power transmitting device is realized by means of a flection at the upper end of the anchor bolt.

Like parts are designated by like numerals throughout the following embodiments.

According to FIG. 1, a base support for pole consists of a base member 11 with a circular, plain base wall 13 which is secured to the foundation 31 by means of an anchor bolt 12 extending perpendicular to the base wall 13 and passed through a central boring 41. The base wall 13 rests flat on the foundation 31, and the anchor bolt 12 is appropriately screwed into a solid base, not represented in FIG. 1, directly, by means of a dowel or the like.

The central boring 44 in the base wall 13 and the anchor bolt 12 define with their center axes a first rotation axis 33 being perpendicular to the surface of the foundation 31 and around which the base wall 13 can be twisted to obtain a desired position before tightening the anchor bolt 12.

A side wall 14 showing a circular cylindric cross-section extends from the base wall 13 off the foundation 31 and parallels the first rotation axis 33, terminating at an elliptical annular and oblique covering wall, surrounding a thru hole and an annular breaking through 26, respectively. The upper, plain bearing surface 18 of the annular covering wall 42 represents a section proceeding oblique to the first rotation axis 33, which results from a distinct angle of e.g. 22.5° to the base wall 13. The axis of the breaking-through 26 standing perpendicular on the annular covering wall 42 defines a second rotation axis 24, intersecting the base wall 13 at approximately half its radius.

As can be seen in FIG. 1, a substantially circular cylindrical pole supporting member 16 is placed onto the base member 11 being co-axial with the base member 11 relative to the first rotation axis 33 in the rotary position shown in FIG. 1. The pole supporting member 16 presents a cylindrical wall 20 substantially aligned with the wall 14 of the base member 11 according to the position shown in FIG. 1, and a lower, oblique mounting wall 23, paralleling the annular covering wall 42 of the base member 11 and being equipped with a central boring 15 which is distinctly placed radially within the breaking-through 26. Around the boring 15 is provided an axial annular projection 25 extending inside the circular breaking-through 26 of the annular covering wall 42 and co-operating with the latter, so to speak like, an insert connection. Consequently, the lower, annular, plain supporting surface 19 of the mounting wall 23 and the upper, plain bearing surface 18 of the annular covering wall 42 are resting flat one upon the other. The side walls of the annular projection 25 and of the breaking-through 26, co-operating with each other, are paralleling the second rotation axis 24, thus assuring a perfect rotational guide.

In its upper area, the pole supporting member 16 presents a somewhat diminishing connecting area 21, onto which is placed a pole 45, e.g. a marking pole, proceeding perpendicularly to the floor 31, as represented in the described embodiment.

The anchor bolt is passed through the central boring 15 from above, perpendicularly to the base wall 13, and extends through the boring 41 in the base wall 13 into the foundation 31 or some other support. Furthermore, a disk 54 is provided beneath the screw head 17.

The inclination between the upper surface 43 of the mounting wall 23 and the lower surface of the head 17 of the anchor bolt 12 is compensated by placing a tapered ring 22 the diameter of which is so large that it distinctly extends beyond the diameter of the central boring 15 and is allowed to fittingly clamp at the upper surface 43 of the mounting wall 23. The wedge angle $\alpha$ of the tapered ring 22 equals the angle $\alpha$ between the first rotation axis 33 and the second rotation axis 24. The faces 27, 28 of the tapered ring 22 are plain.

According to FIG. 1, a rotary disk 9 is still appropriately applied to the tapered ring 22, for manual adjustment, which radially projects over the screw head 17. In the most simple case, the rotary disk 9 can be formed by the disk 54, equipped with an adequately larger diameter, which is then immovably fastened on the tapered ring 22, however. For permitting the rotary disk 9 to have a larger diameter, the tapered ring 22 should be somewhat higher than represented in FIG. 1, in order to obtain more space on the left for a radial extension of the rotary disk 9.

Assembly of the base support according to FIG. 1 is effected as follows:

At first, the base member 11 together with the hereupon attached pole support member 16, with the pole 45 removed, is put on the desired place on the foundation 31. After that, the tapered ring 22 together with the anchor bolt 12 is screwed up loose, to begin with, with the foundation 31 through the borings 15 and 41, respectively. Then, the base member 11 is twisted around the axis 33 and the pole support member 16 around the second rotation axis 24 until the desired position is obtained.

As soon as the base member 11 and the pole supporting member 16 show the exact or desired rotary position relatively to the foundation 31 and to each other, respectively, the anchor bolt 12 is tightened down, whereby concurrently in one single operation the pole supporting member 16 is pressed against the base member 11 and the base member 11 against the foundation 31 so that the once adjusted rotary position is localized.

One has to pay attention that, while twisting the pole supporting member 16 relatively to the base member 11, the tapered ring 22 always takes the rotary position relatively to the base member 11, as represented in FIG. 1. This can be assured by always maintaining the tapered ring 22 by hand relatively to the base member 11 in the position shown in FIG. 1.

In order to avoid jamming of the anchor bolt 12 in the area of the central boring 15 while twisting the pole supporting member 16 relatively to the base member 11, this boring is developed as a cone 44, in conformity with the angle $\alpha$, enlarging from top to bottom.

The insert connection 25, 26 proves to be particularly functional for a perfect handling of the represented base support, as in this way a perfect rotational guide around the second axis 24 is assured which, however, is also given in a certain degree of the upper border 46 in the cone 44. The insert connection 25, 26, however, is equipped with considerably larger guide surfaces.

It is of particular importance for this invention that the lower, slanting surface 38 of the tapered ring 22 proceeds through the intersecting point 47 of the rotary axes 33, 24.

The plain, upper surface 43 of the mounting wall 23, too, intersects the intersecting point 47, as can be seen from FIG. 1.

After tightening down the anchor bolt 12 by means of an adequately formed screw head, e.g. of the hexagon-formed head 17, the base support for pole according to the invention presents the exact angle relatively to the foundation 31, so that the pole 45 to be fastened at the base support can now be mounted in the position shown in FIG. 1. Due to the precise adjustment of the base support, the pole 45 has now automatically obtained the precise angle position relatively to the foundation 31. In FIG. 1 the pole 45 extends perpendicular to the foundation 31.

The embodiment represented in FIG. 2 shows how the base member 11 can be arranged twistable in an anchor body 32 mounted in the foundation 31. The anchor body is flush on top with the foundation 31, but presents radially inside an annular recess 34 being concentric to the first rotation axis 33, into which is introduced an annular projection 35 at the base member 11 for bringing about a functional rotational guide around the axis 33.

In the embodiment as illustrated in FIG. 2, the bearing and supporting surfaces 18, 19 are not developed at an annular covering wall, but rather at the upper face of the side wall 14.

The embodiment shown in FIG. 2 guarantees a jam-free mounting of the separate construction elements by the concentric arrangement of a spherical supporting member 22' at the head 17 of the anchor bolt 12, the center of which coincides with the intersecting point 47 of the rotary axes 33, 24. Below, the spherical supporting member 22' terminates at the periphery of the anchor bolt 12 while on the top it is horizontally cut off, that is at a point where the spherical surfaces have no more function. On the top, the head 17 presents a tool inset opening in the shape of a hexagon through which a wrench is insertable through the access opening 36.

Contrary to the previous described embodiments, the central boring 15 of the embodiment shown in FIG. 2, being located in the mounting wall 23 and in the annular recess 25, respectively, are limited by a ring-shaped spherical supporting surface 22'', proceeding complementary to the spherical supporting member 22'. The spherical supporting surface 22'' begins approximately at the lower face of the annular recess 25 and extends then in the direction of the pole supporting member 16 in relation to the intersecting point 47, comprising an angle of approximately 30°.

The spherical surface section 22'' is concentric with and symmetrical to the second rotation axis 24. The spherical supporting member 22' has to extend its periphery such far that with every rotary position of the pole suppurting member 16 relatively to the base member 11, the spherical surface section 22'' hast to be in a complete sliding or clamping contact with the spherical supporting member 22'.

It is important that the spherical surface sections 22'' at least partly support the spherical supporting member 22' in a manner as can be seen from FIG. 2, so that, while tightening down the anchor bolt 12, the spherical supporting member 22' can exercise clamping forces on the pole support member 16 and the base member 11, respectively, across the spherical surface sections 22'' as well in the direction of the first rotation axis 33 as in the direction of the second rotation axes 24.

Moreover, the spherical surface sections 22'' may only be extended so far in the peripherical direction upwards, i.e. off the base member 11, that the spherical supporting member 22' can still be applied to the spherical surface sections 22''.

Mounting and use of the embodiment according to FIG. 2 comply with the assembly of the embodiment described in FIG. 1, whereby jamming is also avoided with this embodiment without intervention of the operator.

The spherical supporting member 22' is developed as a separate construction element as illustrated in detail in FIG. 3, through which a serial and functional anchor bolt 12 can be passed. Thus, in this case only the sperhical supporting member 22' has to be purpose-made, as represented in FIG. 3, whereby the step 10 for supporting the screw head 17 is of special importance.

The embodiment as referred to in FIG. 4 shows a simplified realization of the object of the invention, in which the power transmitting device 22''' is formed by the angled end stretch 51 of the anchor bolt 12. The angled stretch 51 extends, seen from above, through the central boring 15 and passes over to the anchor bolt 12. The angle of the angled stretch 51 equals the angle $\alpha$ between the rotary axes 24, 33.

A nut 53 is screwed onto the angled stretch 51, operating through a disk 54 on the upper surface 43 of the mounting wall 23. This simplified development also ensures that the disk 54 and the screw nut 53, respectively, are pressing flush on all sides onto the upper plain surface 43 of the mounting wall 23, and that at the same time the requisite traction force for securing the base member 11 in the foundation can be transmitted. Therefore it is essential that the upper stretch of the anchor bolt 12 and particularly the angled stretch 51 in the flexion zone, rest on 55, as shown in FIG. 4, directly at the lower placed border of the central boring 15, i.e. at the mounting wall, as represented in detail in FIG. 4.

According to the embodiment as represented in FIG. 4, at first the anchor bolt 12 is screwed into the foundation or into the anchor body up the required depth by seizing the traction part 51. The screwing operation ends as soon as the angled stretch 51 has reached the positions as shown in FIG. 4. After that, the disk 54 and the screw nut 53 can be placed and tightened down after adjustment of the appropriate rotary position of the base member 11 and the pole supporting member 16.

I claim:

1. A base support for fastening a pole standing off from a foundation, provided with a base member or an anchor body, able to be anchored in a foundation, having below a base wall being attachable in relation to the foundation by a central anchor bolt or a connecting bolt and rotatable around a first rotation axis which is substantially perpendicular to the foundation, above it an all around running side wall and on the top a thru hole surrounded by a circular, ring-shaped covering wall proceeding transversely to the base wall and showing such a dimension that through the thru hole the anchor bolt is insertable, and with a pole supporting member presenting at its top a connecting area for the pole, below an all around running side wall and at its bottom a mounting wall presenting a circular supporting surface being complementary to the bearing surface, whereby the mounting wall is provided with a central boring, being situated within the thru hole, for permitting a rotation around a second rotation axis proceeding perpendicular to the bearing or supporting surface, whereby the central boring serves for passing through a fastening bolt and secures the mounting wall to the pass wall, thus establishing a first axial clamp joint between the bearing and the supporting surface, the fastening bolt being axially braced against the mounting wall and accessible through an access opening in the upper area of the pole supporting member, whereby, preferably radially outside the central boring between the annular covering wall and the mounting wall, an axial, dynamically balanced insert connection is provided, being concentric to the second rotation axis, by means of which the base member and the pole supporting member are rotatable around the second rotation axis, but radially immovably connected, characterized in that, for a simulaneous performance of the fastening bolt functioning, the anchor bolt (12) is passed through the central boring (15) of the mounting wall (23), and is, with its head area, in frictional connection with a power transmission device (22; 22'; 22''; 22''') transmitting at least partially the component running perpendicularly to the bearing and supporting face (18, 19) of the tension force operating in axial direction of the anchor bolt (12), the power transmission device being, in all relative rotary positions of the base member (11) and of the pole supporting member (16), in a jam-free frictional connection proceeding perpendicular to the mounting wall and in axial direction of the anchor bolt (12), respectively, as well with the pole supporting member (16) as with the anchor bolt (12).

2. A base support for pole according to claim 1, characterized in that the power transmitting device is developed as a tapered ring (22) having a wedge angle ($\alpha$) equalling the angle between the two rotation axes (23, 24), through which the anchor bolt (12) extends, and at the upper surface (27) of which, proceeding perpendicular to the axis (33) of the anchor bolt (12), the head of the anchor bolt (12) sits close, whereby the lower wedge surface (28) preferably sits close on all sides at the oblique mounting wall (23).

3. A base support for pole according to claim 1, characterized in that the power transmitting device is developed as a spherical supporting member (22') provided in the head area of the anchor bolt (12), the center of which coincides with the intersecting point of the two rotation axes (24, 33), and as hereto complementary spherical surface sections (22''), at the mounting wall (23) of the pole supporting member (16), whereby the spherical supporting member (22') and the spherical surface sections (22'') extend and are disposed in such a way that, on the one hand, they are capable of transmitting the tension forces, and, on the other hand, to permit a free relative rotation of the base member (11) and the pole supporting member (16) with the anchor bolt (12) being relaxed, and that the spherical supporting member (22') preferably extends upwards and downwards, at least as far as the spherical surface sections (22''), with every angle of rotation, will reach.

4. A base support for pole according to claim 3, characterized in that the spherical surface sections (22'') located at the borders of the central boring (15) of the mounting wall (23), are developed to form a bowl being open towards the top and a ring being concentric and symmetric to the second rotation axis (24).

5. A base support for pole according to claim 3, characterized in that the spherical supporting member (22') is arranged as a separate part in the head area of the anchor bolt (12).

6. A base support for pole according to claim 1, characterized in that the power transmitting device is formed by a traction part (51) at the upper end of the anchor bolt (12) being angled by ($\alpha$) between the two rotation axes (24, 33), and that the traction part (51) extends through the central boring (15) and is braced against the upper surface (43) of the mounting wall (23).

7. A base support for pole according to claim 6, characterized in that the traction part (51, 52) presents a male thread in the area of the central boring and above it, and is braced against the surface (43) by a screw nut (53) paralleling to the upper surface (43) of the mounting wall (23).

8. A base support for pole according to claim 7, characterized in that the traction part (51) is formed by an angled upper stretch of the anchor bolt (12) itself.

9. A base support for pole according to claim 1, characterized in that an axial insert connection (34, 35) being dynamically balanced and concentric to the first rotation axis (33) is also provided between the base wall (13) of the base member (11) and an anchor body (32) being mounted in the foundation (31).

* * * * *